US006976745B2

(12) United States Patent
Dobler et al.

(10) Patent No.: US 6,976,745 B2
(45) Date of Patent: Dec. 20, 2005

(54) SNAP-ON SLIDE AND RAIL ASSEMBLY

(75) Inventors: Karl J. Dobler, Cypress, TX (US); Kelly K. Smith, Spring, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/956,277

(22) Filed: Sep. 19, 2001

(65) Prior Publication Data

US 2003/0052580 A1 Mar. 20, 2003

(51) Int. Cl.[7] ..... A47B 88/04
(52) U.S. Cl. ..... 312/334.44; 312/333
(58) Field of Search ..... 312/330.1, 333, 312/334.1, 334.5, 334.7, 334.8, 334.44, 334.46, 312/350; 211/26; 384/18, 19, 20, 21, 22

(56) References Cited

U.S. PATENT DOCUMENTS

| | | | | |
|---|---|---|---|---|
| 1,231,291 A | | 6/1917 | Otte | |
| 1,938,908 A | | 12/1933 | Hunter | |
| 1,963,220 A | | 6/1934 | Anderson | |
| 2,277,702 A | | 3/1942 | Kennedy et al. | |
| 2,346,167 A | | 4/1944 | Jones et al. | |
| 2,679,447 A | | 5/1954 | Bissman | |
| 2,960,376 A | | 11/1960 | Myers | |
| 3,059,978 A | | 10/1962 | Fall | |
| 3,092,429 A | | 6/1963 | Barnes | |
| 3,133,768 A | * | 5/1964 | Klakovich | 312/334.8 X |
| 3,377,115 A | | 4/1968 | Hansen et al. | |
| 3,488,097 A | | 1/1970 | Fall | |
| 3,650,578 A | | 3/1972 | Del Vecchio et al. | |
| 3,679,274 A | * | 7/1972 | Nance | 384/21 |
| 3,687,505 A | | 8/1972 | Fall et al. | |
| 3,712,690 A | | 1/1973 | Fall | |
| 3,716,284 A | | 2/1973 | Vogt | |
| 3,738,716 A | | 6/1973 | Lambert | |
| 3,778,120 A | | 12/1973 | Hagen et al. | |
| 3,779,623 A | | 12/1973 | Motohashi | |
| 3,844,627 A | * | 10/1974 | Gutner | 312/334.5 X |
| 3,901,564 A | | 8/1975 | Armstrong | |
| 3,912,341 A | | 10/1975 | Stein | |
| 4,025,138 A | | 5/1977 | Kittle | |
| 4,067,632 A | | 1/1978 | Sekerich | |
| 4,191,436 A | | 3/1980 | Cherry | |
| 4,194,793 A | | 3/1980 | Offermans | |

(Continued)

FOREIGN PATENT DOCUMENTS

| | | | | |
|---|---|---|---|---|
| DE | 4230706 | * | 3/1994 | 312/334.44 |

OTHER PUBLICATIONS

Compaq Typhoon Mechanical Specification Version 0.01, Nov. 8, 1994 by Joseph Allen, Systems Division of Compaq Computer Corporation, 15 pages.

(Continued)

*Primary Examiner*—James O. Hansen

(57) ABSTRACT

A snap-on sliding track assembly and method including a rail assembly and a slide assembly adapted to be securely mounted to each other without loose hardware and tools. The rail assembly has a latch and a plurality of standoffs. The slide assembly has a latch receptacle adapted to engage the latch and a plurality of standoff openings. The slide assembly includes a standoff opening for each corresponding standoff. The sliding track assembly is assembled by positioning the slide assembly standoff openings onto the standoffs of the rail assembly. The slide assembly is slid relative to the rail assembly to secure the slide assembly to the rail assembly. A lock mechanism is automatically engaged upon the sliding action of the slide assembly relative to the rail assembly.

21 Claims, 7 Drawing Sheets

U.S. PATENT DOCUMENTS 4,324,439 A 4/1982 Hagen et al.
4,331,369 A * 5/1982 Lazar et al. ..... 384/23
4,427,245 A 1/1984 Litchfield et al.
4,479,198 A 10/1984 Romano et al.
4,479,263 A 10/1984 Row enfeldt et al.
4,662,761 A 5/1987 Hoffman
4,772,079 A 9/1988 Douglas et al.
4,949,934 A 8/1990 Krenz et al.
4,977,532 A 12/1990 Borkowicz et al.
4,988,214 A 1/1991 Clement
5,143,432 A 9/1992 Ohshima et al.
5,162,845 A 11/1992 Ariyama et al.
5,164,886 A 11/1992 Chang
5,197,789 A 3/1993 Lin
5,208,722 A 5/1993 Ryan et al.
5,209,572 A 5/1993 Jordan
5,262,923 A 11/1993 Batta et al.
5,269,598 A 12/1993 Liu
5,277,615 A 1/1994 Hastings et al.
5,278,351 A 1/1994 Herrick
5,284,254 A 2/1994 Rinderer
5,340,340 A 8/1994 Hastings et al.
5,372,417 A 12/1994 Buie et al.
5,381,315 A 1/1995 Hamaguchi et al.
5,397,176 A 3/1995 Allen et al.
5,417,496 A 5/1995 Hobbs
5,438,476 A 8/1995 Steffes
5,460,441 A 10/1995 Hastings et al.
5,469,037 A 11/1995 McMurtrey, Sr. et al.
5,491,611 A 2/1996 Stewart et al.
5,551,775 A 9/1996 Parvin
5,552,959 A 9/1996 Penniman et al.
5,571,256 A * 11/1996 Good et al. ..... 211/26
5,586,817 A 12/1996 Hubbard et al.
5,598,318 A 1/1997 Dewitt et al.
5,637,124 A 6/1997 Diachuk
5,684,671 A 11/1997 Hobbs et al.
5,717,575 A 2/1998 Copeland et al.
5,726,866 A 3/1998 Allen
5,734,557 A 3/1998 McAnally et al.
5,737,184 A 4/1998 Lai
5,768,097 A 6/1998 Jelinger
5,772,294 A 6/1998 Hendrich et al.
5,779,333 A * 7/1998 Lautenschlager ..... 312/334.15
5,784,251 A 7/1998 Miller et al.
5,784,252 A 7/1998 Villa et al.
5,801,921 A 9/1998 Miller
5,823,647 A 10/1998 Miyoshi
5,833,337 A * 11/1998 Kofstad ..... 312/334.5
5,839,373 A 11/1998 Lin
5,852,543 A 12/1998 Kannler
5,941,621 A * 8/1999 Boulay et al. ..... 312/334.5 X
6,021,047 A 2/2000 Lopez et al.
6,070,742 A 6/2000 McAnally et al.
6,142,590 A 11/2000 Harwell
6,181,549 B1 1/2001 Mills et al.
6,185,092 B1 2/2001 Landrum et al.
6,201,690 B1 3/2001 Moore et al.
6,209,979 B1 * 4/2001 Fall et al. ..... 312/330.1
6,224,177 B1 5/2001 Chu
6,230,903 B1 * 5/2001 Abbott ..... 211/26
6,231,138 B1 5/2001 Janson
6,257,683 B1 7/2001 Yang
6,259,605 B1 7/2001 Shmitt
6,305,556 B1 10/2001 Mayer
6,360,900 B1 3/2002 Carbonneau et al.
6,385,036 B1 5/2002 Chien
6,422,399 B1 7/2002 Castillo et al.
6,424,534 B1 7/2002 Mayer et al.
6,431,668 B1 * 8/2002 Reddicliffe ..... 312/334.1 X
6,490,153 B1 12/2002 Casebolt et al.
6,547,081 B1 4/2003 Kaminski
6,554,142 B2 4/2003 Gray
6,574,100 B1 6/2003 Anderson
6,588,866 B2 * 7/2003 Cheng ..... 312/334.7
6,601,713 B2 8/2003 Kaminski
6,615,992 B1 9/2003 Lauchner et al.
6,644,480 B2 11/2003 Kaminski
6,655,534 B2 12/2003 Williams et al.
6,666,340 B2 12/2003 Basinger et al.
6,681,942 B2 1/2004 Haney
6,702,124 B2 3/2004 Lauchner et al.
6,702,412 B2 3/2004 Dobler et al.
6,773,080 B2 8/2004 Chen et al.
2001/0037985 A1 11/2001 Varghese et al.
2002/0104942 A1 8/2002 Mimlitch, III et al.
2003/0193781 A1 10/2003 Mori
2004/0080247 A1 4/2004 Dobler et al.
2004/0120123 A1 6/2004 Mayer
2004/0159618 A1 8/2004 Nguyen et al.
2004/0217073 A1 11/2004 Dobler et al.

OTHER PUBLICATIONS

Universal, Low-Cost Hard-File Mounting Assembly, IBN Technical Disclosure Bulletin, vol. 28, No. 6, Nov. 1985, 2 pages.

Spring-Loaded File Rails, IBM Technical Disclosure Bulletin, vol. 28, No. 12, May 1986, 3 pages.

Bridge Assembly for Mounting Interchangeable Electromagnetic Devices, IBM Technical Disclosure Bulletin, vol. 29, No. 9, Feb. 1987, 2 pages.

Direct-Access Storage Device Commodity-Stacking Plates, IBM Technical Disclosure Bulletin, vol. 30, No. 1, Jun. 1987, 2 pages.

U.S. Appl. No. 10/427,134, filed May 1, 2003, Entitled: "System and Method for Utilizing a Tool-Less Rail in a Rack"; Inventor: Dobler et al.

U.S. Appl. No. 09/691,382, filed Oct. 18, 2000, Entitled: "Rack System for Mounting Electronic Devices"; Inventor: Bolognia et al.

* cited by examiner

SNAP-ON SLIDE AND RAIL ASSEMBLY

CROSS-REFERENCE TO RELATED APPLICATIONS

Not applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to a slide and rail assembly and method of assembling same, and more particularly, to a slide and rail assembly and method for a server chassis mounted in a rack.

2. Description of the Related Art

There are numerous incidences where a sliding track assembly is used. For example, a sliding track assembly is used for sliding mechanisms for pull out drawers and shelves. Typically, the sliding track assembly includes a slide assembly mounted to a rail assembly. Typically, the rail assembly is mounted in a case, rack, housing or other framed assembly and the slide assembly is attached to the drawer, shelf or other device. The slide assembly cooperates with the rail assembly and provides the extension mechanism for the drawer or shelf.

Typically, the mounting and installation of the slide and rail assembly requires loose hardware and tools. The assembly of the components with several pieces of loose hardware and tools is time consuming, inefficient and requires a substantial amount of organization. The sliding track assemblies are usually used in pairs—a left side and a right side. Frequently, several pairs of sliding track assemblies are used in a single rack or housing. For example, there are racks used to house servers for computer networks. A single rack may utilize fifteen or more pairs of sliding track assemblies. There are numerous other examples of similar requirements for significant quantities of sliding track assemblies. Thus, it is apparent that a significant amount of time and savings would result by simplifying the assembly of the slide and rail assemblies.

It is also important that the slide assembly securely mount to the rail assembly such that the components do not accidentally disengage each other. Thus, it is desirable that the components lock into each other to prevent accidental disengagement. However, it is also desirable that the slide and rail assemblies can be unlocked and disengaged from each other without tools and with a minimum of difficulty.

There is a need for a sliding track assembly having a slide assembly and a rail assembly that can be assembled together easily and conveniently. It is desirable that the assembly require no loose hardware and tools. The sliding track assembly should be secure and the slide and rail assemblies should lock together. Additionally, it is desirable that the slide and rail assembly be simple to install and require little time for the installation. Further, it is desirable that the slide assembly be easily unlocked and disengaged from the rail assembly, if desired.

BRIEF SUMMARY OF THE INVENTION

The present invention is a sliding track assembly having a slide assembly capable of quickly, easily and securely engaging a rail assembly and a method for assembling the slide and rail assemblies. The assembly of the slide assembly to the rail assembly requires no loose hardware or tools. The slide assembly be easily unlocked and disengaged from the rail assembly, if desired.

The rail assembly includes a spring latch and one or more shoulder standoffs. The slide assembly includes an opening, preferably key-hole shaped, for each shoulder standoff and a latch opening that engages the spring latch.

The method of assembling the slide assembly to the rail assembly is very simple and requires very little time. Furthermore, the slide assembly can also be very easily and quickly removed from the rail assembly, if desired. To install the slide assembly to the rail assembly, the keyhole-shaped openings of the slide assembly are positioned onto the shoulder standoffs and the spring latch depressed by the slide assembly being in contact with the rail assembly. The slide assembly is slid along the keyhole-shaped openings until the latch spring reaches the latch opening and extends into the latch opening. Once in position, the attached slide assembly cannot be removed unless the spring latch is depressed and the slide assembly slid off of the shoulder standoffs.

BRIEF DESCRIPTION OF THE SEVERAL VIEWS OF THE DRAWINGS

The objects, advantages and features of the invention will become more apparent by reference to the drawings which are appended hereto and wherein like numerals indicate like parts and wherein illustrated embodiments of the invention are shown, in which.

DETAILED DESCRIPTION OF THE INVENTION

Figure 7:
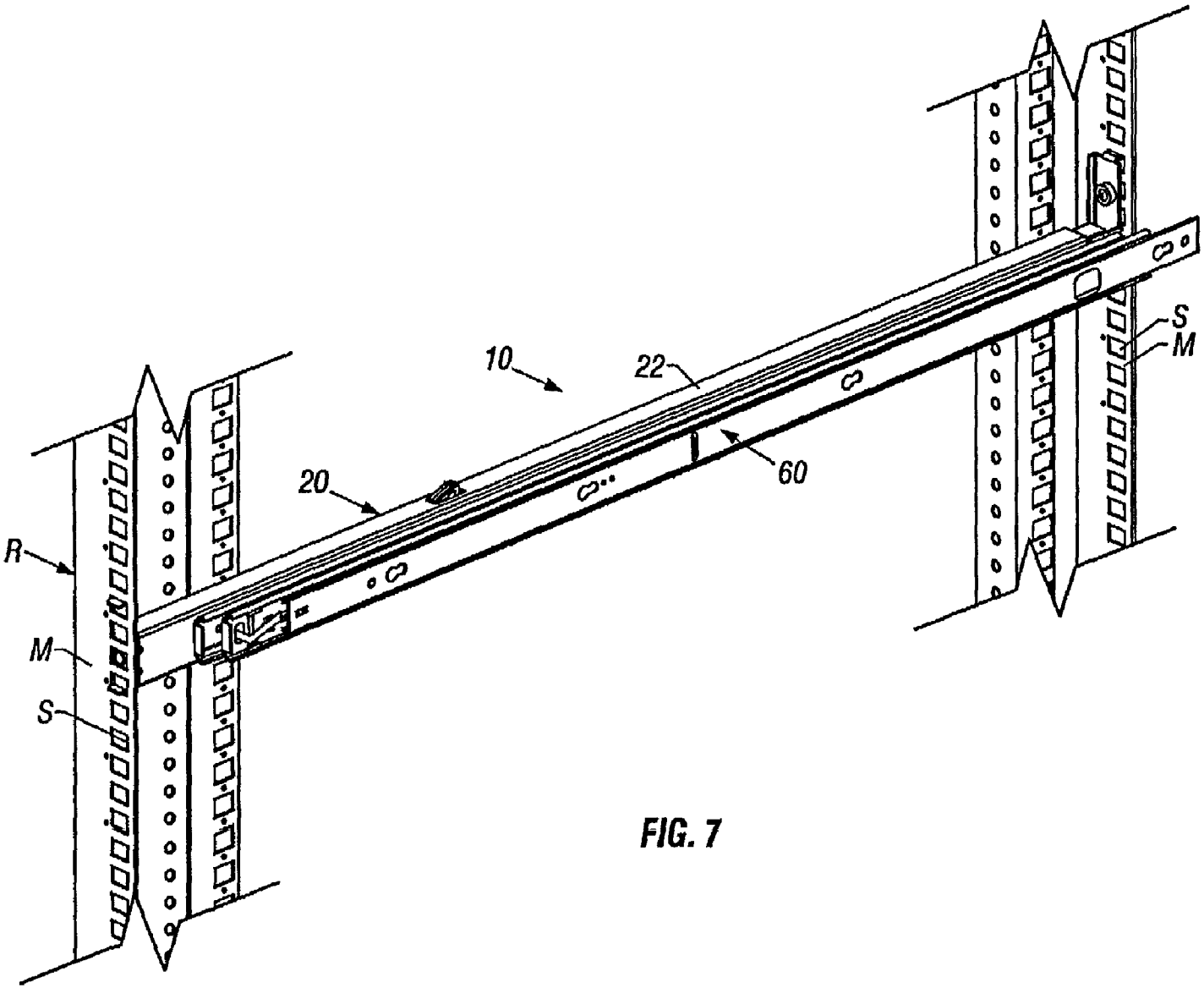
FIG. 7 is a perspective view of the sliding track assembly installed in a rack.

The present invention will now be described in greater detail with specific reference to the drawings. The sliding track assembly, generally designated as 10, includes a rail assembly 20 and a slide assembly 60 as shown in FIG. 7. The rail and slide assemblies, 20 and 60 respectively, are adapted to quickly and easily attach securely together without the use of tools or other fasteners. Additionally, the assemblies 20 and 60 are adapted to be quickly and easily detached from each other without the use of tools.

In the preferred embodiment of the present invention, the rail assembly 20 includes a support rail 22 adapted to span between opposing members M of a rack R, stand or other device as shown in FIG. 7. Alternatively, the support rail 22 could be attached to a side member of the rack, stand or other device. It is to be understood that the support rail 22 can be mounted to the rack or stand with mechanical fasteners such as screws or nails. In some instances it may be desirable to be able to adjust the elevation of the rail assemblies 20 in a rack or other device or simply allow installation without the use of tools. Thus, an embodiment of the support rail 22 that is easy and quick to install and requires no tools for installation in a rack R or other device is shown in FIGS. 1–3, 6 and 7. It is to be understood that certain of the described features are not required for the present invention, but may be desirable for the required application of the sliding track assembly 10.

Figure 1:
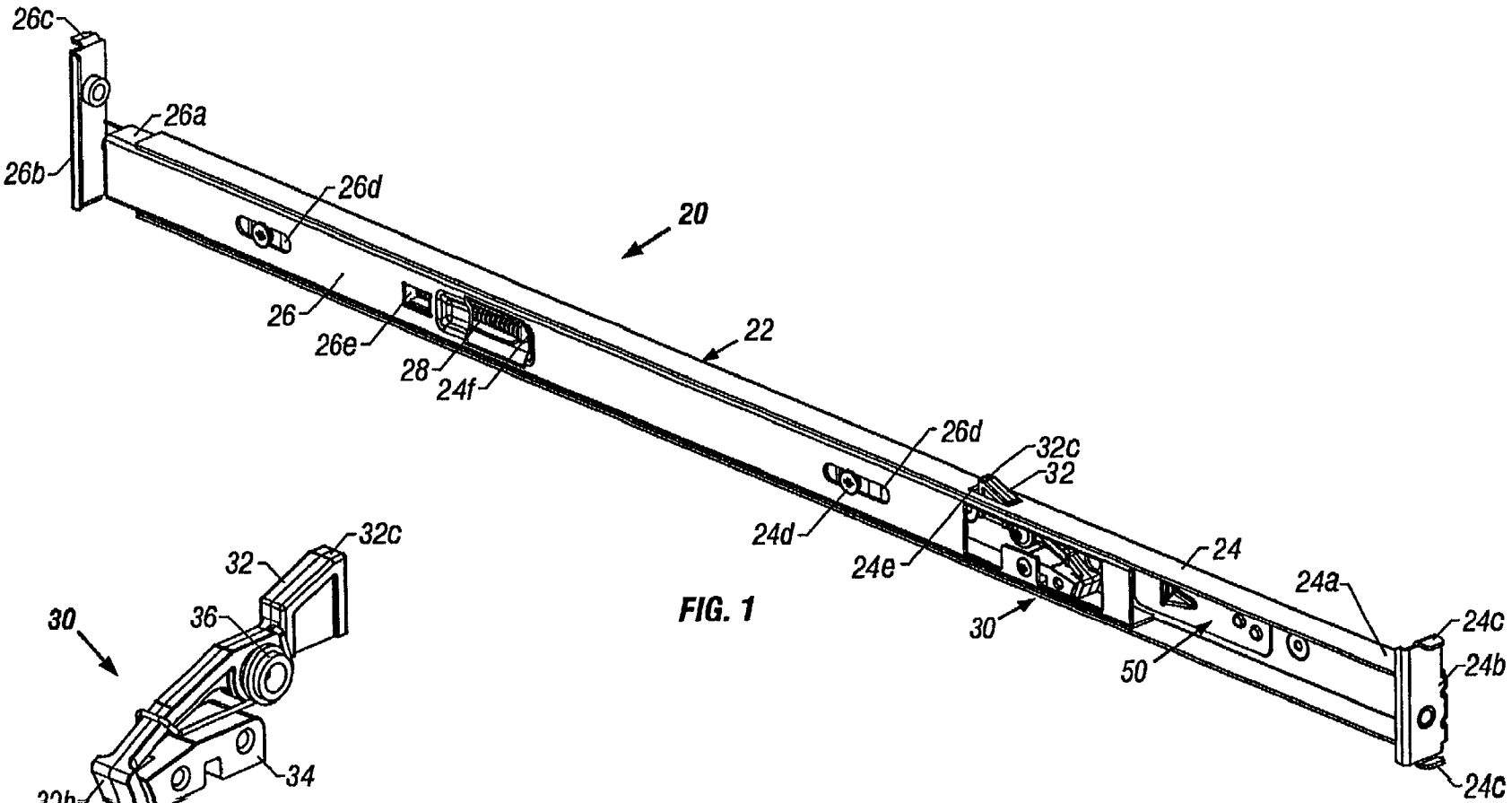
FIG. 1 is a perspective view of a rail assembly according to a preferred embodiment of the present invention.
Figure 2:
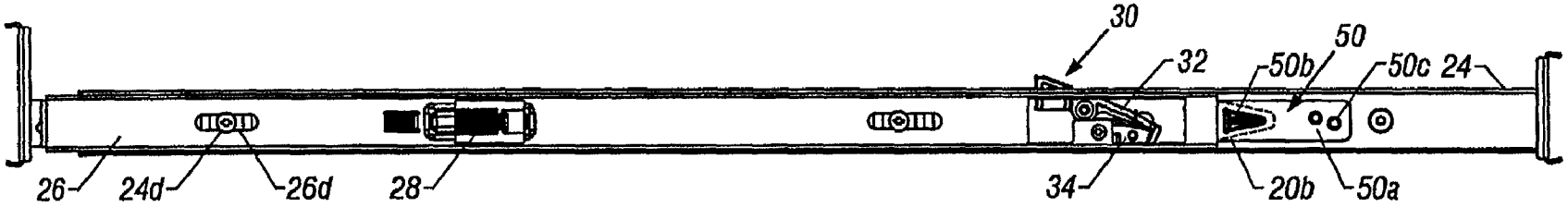
FIG. 2 is a side elevation view of the rail assembly of FIG. 1.

Referring to FIGS. 1 and 2, the support rail 22 of this embodiment comprises cooperating first and second rail members, 24 and 26 respectively. The support rail members 24 and 26 are generally C-shaped in cross-section with the second rail member 26 slightly smaller in height and width than the first rail member 24 so as to allow the second rail member 26 to slide within the first rail member 24.

As shown in FIG. 1, the distal ends 24*a* and 26*a* of the rail members 24 and 26, respectively, include mounting brackets 24*b* and 26*b*. Each mounting bracket 24*b*, 26*b* includes one or more mounting tabs 24*c*, 26*c*, respectively. The mounting tabs 24*c*, 26*c* are adapted to be received in mounting slots S in the rack R (FIG. 7), stand, or other device in which the sliding track assembly 10 is being installed.

As indicated above, the overall length of the support rail 22 could be fixed upon installation by various means, including mechanical fasteners, to restrict relative movement between the first and second rail members 24 and 26. However, in the embodiment shown in FIGS. 1–3 the first and second rail members 24 and 26 are allowed limited longitudinal movement relative to each other. As shown in FIGS. 1 and 2, the second rail member 26 is shown as having one or more longitudinal elongated slots 26*d*. A fastener 24*d*, such as a screw, having a head larger than the slot height is inserted through the elongated slot 26*d* and fastened to the first rail member 24, preferably via a threaded connection. The fasteners 24*d* secure the rail members 24 and 26 to each other and allow sliding longitudinal movement limited to the length of the elongated slot 26*d*.

Referring to FIG. 1, the rail assembly 20 includes a compression spring 28 positioned between opposing folded tabs 24*f* and 26*e* of the first and second rail members 24 and 26, respectively, to provide a spring-biased force to extend the rail members 24 and 26 in an outwardly direction along their length. The spring 28 is compressed during the installation of the mounting tabs 24*c*, 26*c* in the rack slots S and thus serves to exert an outward force against each of the rail members 24, 26 to maintain the mounting tabs 24*c*, 26*c* in their respective slots S.

Figure 4:
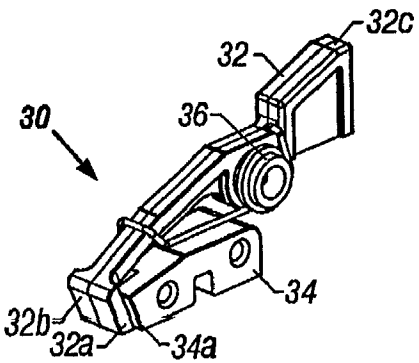
FIG. 4 is a perspective view of a locking mechanism of the rail assembly of FIG. 1.

Referring to FIGS. 1–4, the rail assembly 20 described above may include a locking mechanism 30 comprised of a trigger 32, a catch 34 and a spring 36. FIG. 4 shows an enlarged view of the locking mechanism 30. The catch 34 is securely mounted to the inside portion of the second rail member 26 and the trigger 32 is pin or pivotally connected to the first rail member 24 as shown in FIGS. 1 and 2. The catch 34 includes an angled face 34*a* adapted to engage a correspondingly angled trigger face 32*a* at the front 32*b* of the trigger 32 when the rail assembly 20 is installed as explained below. The trigger 32 has a rear 32*c* which extends through a window 24*e* in the first rail member 24. The trigger spring 36 exerts a spring force to cause the front 32*b* of the trigger 32 to rotate towards the catch 34 and the rear 32*c* of the trigger 32 to extend through the window 24*e*.

Installation of the rail assembly 20 described above is accomplished by inserting the mounting tab or tabs at one end, for example the first rail member tabs 24*c*, into the slots S of the rack R. The trigger rear 32*c* is depressed and the rail assembly 20 compressed longitudinally allowing the catch face 34*a* to pass below the raised trigger front 32*b*. The second rail member tabs 26*c* are then aligned and inserted into the appropriate slots S in the rack R. As the compression spring 28 expands and forces the second rail member 26 to extend, the catch 34 moves relative to the trigger 32 to a point where the catch 34 travels beyond the trigger face 32*a*, thus permitting the face 32*a* of the spring-biased trigger 32 to engage the catch face 34*a*. It is important to understand that when the rail assembly 20 is installed in the rack R, the trigger 32 captures the catch 34 and the faces 32*a* and 34*a* are contacting or in close proximity (FIG. 2) such that none of the tabs 24*c* and 26*c* can be disengaged from the rack slots S unless the trigger rear 32*c* is depressed to allow inward relative movement of the support rail members 22 and 24.

Figure 3:
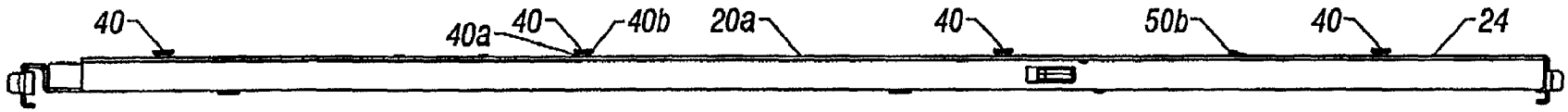
FIG. 3 is a top plan view of the rail assembly of FIG. 1.
Figure 6:
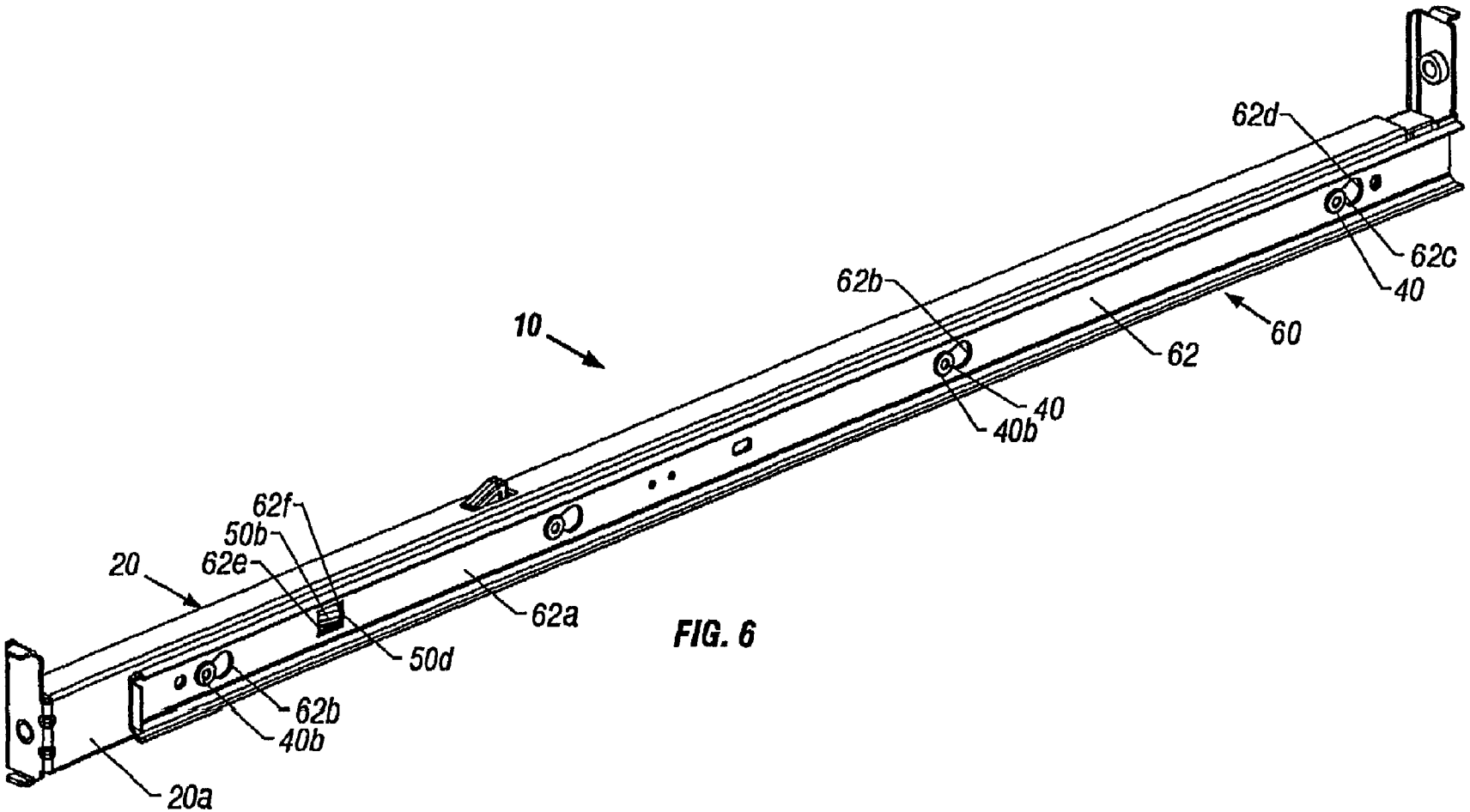
FIG. 6 is a perspective view of the sliding track assembly in the assembled condition with a portion of the slide assembly removed for clarity.

Referring to FIGS. 3 and 6, the rail assembly 20 includes one or more shoulder standoffs 40 extending beyond a face 20*a* of the rail assembly 20. The shoulder standoff 40 includes a short shaft 40*a* (FIG. 3), preferably cylindrical, and a head 40*b* (FIGS. 3 and 6). Preferably, the head 40*b* is circular and has a diameter greater than the diameter of the short shaft 40*a*. The short shaft 40*a* extends generally perpendicularly from the rail assembly face 20*a* and the head 40*b* preferably includes a lower flat face that is generally parallel with the rail assembly face 20*a*.

Figure 5:
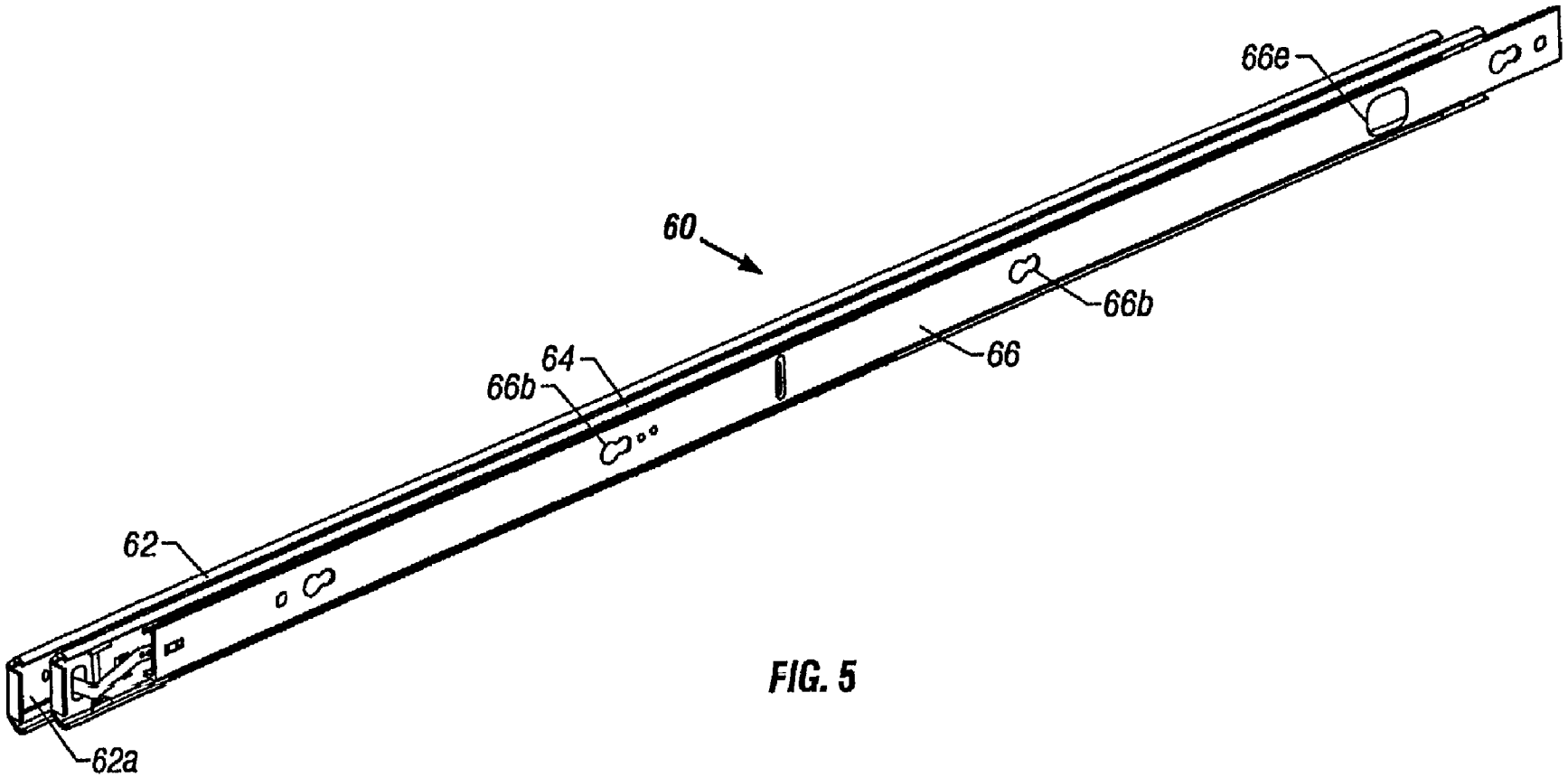
FIG. 5 is a perspective view of a slide assembly according to a preferred embodiment of the present invention.

With reference to FIGS. 5 and 6, the slide assembly 60 includes a slide member 62 having a generally flat portion 62*a* with a keyhole-shaped opening 62*b* for each shoulder standoff 40. It is to be understood that in FIG. 6 a portion of the slide assembly 60 has been removed for purposes of clarity. The opening 62*b* includes a slotted portion 62*c* which expands to an enlarged circular portion 62*d*. The slotted portion 62*c* has a height slightly greater than the short shaft 40*a* and the circular portion 62*d* is slightly greater than the diameter of the head 40*b* of the shoulder standoff 40. Thus, to mount the slide assembly 60 to the rail assembly 20 the heads 40*b* of the shoulder standoffs 40 are inserted through the enlarged circular portions 62*d* of the slide member 62 and the slide member 62 slid such that the short shafts 40*a* are received in the slotted portion 62*c* and retained therein by the head 40*b* lower face contacting the slide member 62.

Referring to FIGS. 1 and 2, the rail assembly 20 preferably includes a latch mechanism 50 mounted to the rail assembly 20. The latch mechanism 50 includes a spring plate 50*a* having a raised portion 50*b* which is allowed to extend through a window 20*b* in the rail assembly 20. Preferably, the spring plate 50*a* is mounted to the rail assembly 20 near a first end 50*c* of the spring plate 50*a*. Referring to FIG. 6, the slide member 62 includes a latch opening 62*e* having an edge portion 62*f* adapted to engage a spring latch edge 50*d* of the raised portion 50*b* to lock the slide assembly 60 to the rail assembly 20. As shown in FIG. 6, the spring latch edge 50*d* springs through the latch opening 62*e* adjacent the opening edge portion 62*f* upon the shoulder standoffs 40 becoming seated in the slotted portions 62*c* of the keyhole-shaped openings 62*b*.

As described above, the method of assembling the slide assembly 60 to the rail assembly 20 is very simple and requires very little time. Furthermore, the slide assembly 60 can also be very easily and quickly removed from the rail assembly 20, if desired. To install the slide assembly 60 to the rail assembly 20, the keyhole-shaped openings 62*b* of the slide member 62 are positioned onto the shoulder standoffs

40. The raised portion 50*b* of the spring latch mechanism 50 extending through window 20*b* is depressed by the slide member 62 contacting the rail assembly 20. The slide member 62 is slid along the rail assembly 20 with the shoulder standoffs 40 within the keyhole-shaped openings 62*b* until the spring latch edge 50*d* of the raised portion 50*b* reaches the latch opening 62*e* and springs into the latch opening 62*e*. Once in position, the attached slide assembly 60 cannot be removed unless the raised portion 50*b* of the spring latch mechanism 50 is depressed below the latch opening 62*e* and the slide member 60 slid off of the shoulder standoffs 40.

Figure 9:
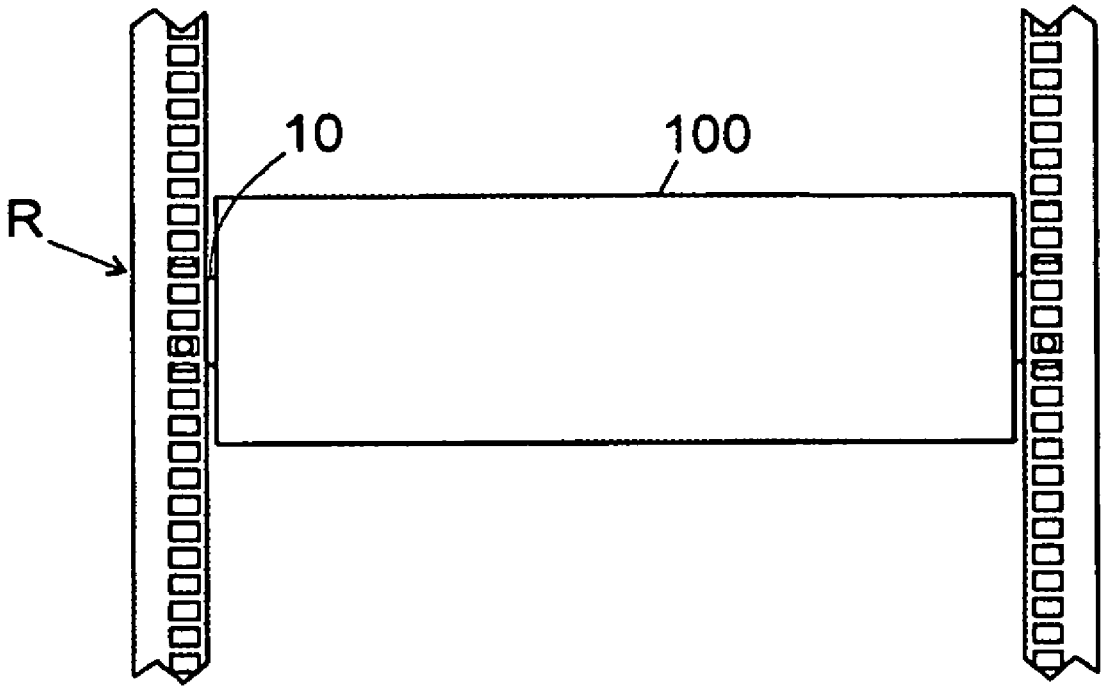
FIG. 9 is a front view of a slide assembly and chassis according to an embodiment of the present invention.

It is to be understood that the sliding track assembly 10 has been described as a single assembly. However, it is to be understood that the sliding track assembly 10 typically includes a left sliding track assembly 10 and a right sliding track assembly 10, as illustrated in FIG. 9. Thus, a pair of sliding track assemblies 10 will typically be used together to support a drawer, shelf, tray or other type of housing 100, as illustrated in FIG. 9.

Referring to FIG. 5, the slide assembly 60 may include one or more additional sliding members referenced as 64 and 66 forming a part of the slide mechanism. It is to be understood that such slide mechanisms are well known and the present invention is not restricted to a particular type. It is noted that the sliding member 66 is shown as having a plurality of keyhole-shaped openings 66*b* which are similar in shape to openings 62*b* in the slide member 62. The sliding member 66 is also shown as having a latch opening 66*e* similar in shape to the latch opening 62*e*. It is to be understood that a housing 100, such as a server chassis as shown in FIG. 9, may be mounted between a pair of the sliding members 66 using the plurality of keyhole-shaped openings 66*b* and the latch opening 66*e* in the same manner as described above with respect to the rack assembly 20 and the slide assembly 60.

Figure 8:
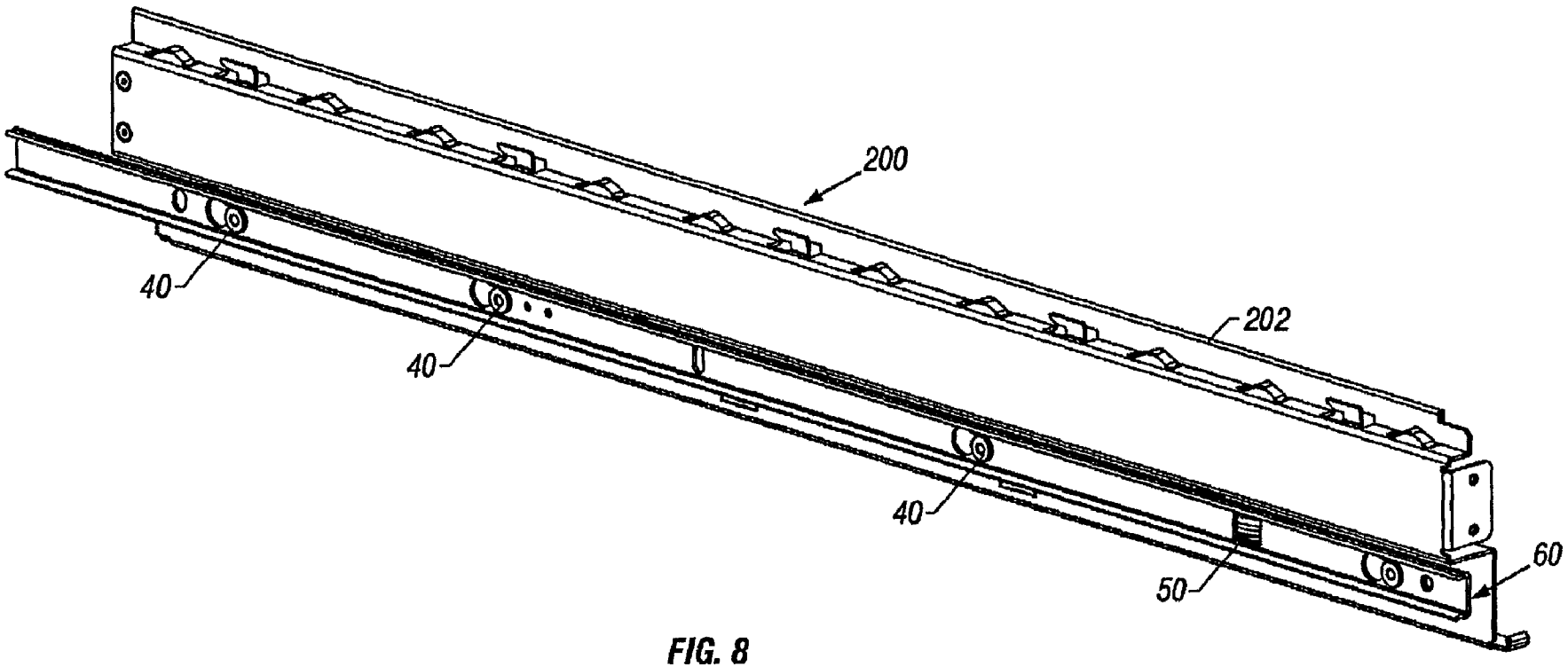
FIG. 8 is a perspective view of a second embodiment of the sliding track assembly in an assembled condition with a portion of the slide assembly removed for clarity.

As discussed above, the rail assembly 20 disclosed one embodiment in which the rail assembly snapped into position with spring-biased rail members 22 and 24. FIG. 8 shows one alternative embodiment of the rail assembly identified as 200. The rail assembly 200 includes a chassis member 202 adapted to be mounted into the rack R or other housing. The rail assembly 200 includes the shoulder standoffs 40 and the locking mechanism 50 as described above. As shown in FIG. 8, the slide assembly 60 mounts in the same manner as described above.

The foregoing disclosure and description of the invention is illustrative and explanatory thereof, and various changes in the size, shape, and materials, as well as in the details of illustrative construction and assembly, may be made without departing from the spirit of the invention.

We claim:

1. A sliding track assembly adapted to slidably mount a chassis in a housing, comprising:

a rail extending lengthwise between opposite mounting ends adapted to mount to opposite sides of the housing, the rail including a latch and a non-threaded shoulder standoff; and a slide assembly, comprising:

a first slide member non-threadingly coupled to the rail, wherein the first slide member comprises an opening releasably receiving the non-threaded shoulder standoff and a latch receptacle releasably engaging the latch to prevent withdrawal of the non-threaded shoulder standoff from the opening; and a second slide member slidingly engaged lengthwise with the first slide member, wherein the second slide member is adapted to couple releasably and non-threadingly with the chassis, the second slide member having a plurality of shoulder standoff openings and a chassis latch receptacle adapted to engage the chassis.

2. The sliding track assembly of claim 1, wherein said latch is a spring plate.

3. The sliding track assembly of claim 1, wherein said latch receptacle is an opening in said slide assembly.

4. The sliding track assembly of claim 1, wherein said rail includes a plurality of non-threaded shoulder standoffs and said slide assembly includes a corresponding number of shoulder standoff openings.

5. The sliding track assembly of claim 1, wherein said opening adapted to receive the non-threaded shoulder standoff is a key-hole shaped opening.

6. A snap-on sliding track assembly comprising:

a rail assembly including a latch and a plurality of non-threaded standoffs; and a slide assembly, comprising:

a first slide member having a latch receptacle adapted to engage the latch and a plurality of openings, each opening adapted to receive one non-threaded standoff interlockingly therein without a threaded fastener; and a second slide member slidingly engaged lengthwise with the first slide member, wherein the second slide member comprises a plurality of shoulder standoff openings and a chassis latch receptacle adapted to engage a chassis.

7. The snap-on sliding track assembly of claim 6, wherein said latch is a spring plate having a raised portion and said latch receptacle is an opening adapted to receive said latch raised portion.

8. The snap-on sliding track assembly of claim 6, wherein each non-threaded standoff includes a short shaft and a head and each opening is keyhole-shaped having a first portion adapted to receive the standoff head and a second portion adapted to received the standoff short shaft.

9. The snap-on sliding track assembly of claim 8, wherein said standoff head has a diameter greater than the height of said opening second portion.

10. The snap-on sliding track assembly of claim 8, wherein said latch is a spring plate having a raised portion and said latch receptacle is an opening adapted to receive said latch raised portion.

11. A snap-on sliding track assembly comprising:

a rail and slide assembly adapted to mount to legs of a rack, comprising:

a rail assembly having opposite mounting ends adapted to mount to opposite legs of the rack;

a slide assembly coupled to the rail assembly;

one of said rail and slide assemblies including a latch and the other of the rail and slide assemblies including a latch receptacle adapted to engage the latch; and one of the rail and slide assemblies including a plurality of non-threaded standoffs and the other of the rail and slide assemblies including a plurality of openings, each opening adapted to receive one non-threaded standoff interlockingly therein without a threaded fastener;

and;

a chassis slide assembly slidingly coupled to the slide assembly and adapted to engage a chassis, wherein the chassis slide assembly comprises a chassis standoff opening and a chassis latch receptacle.

12. A device mountable in a housing, comprising:

a chassis; and a rail and slide assembly coupled to the chassis, comprising:

a rail extending lengthwise between opposite mounting ends adapted to mount to opposite sides of the housing, wherein the rail includes a latch and at least one non-threaded shoulder standoff; and a slide mechanism, comprising:

a first slide member non-threadingly coupled to the rail, wherein the first slide member comprises an opening releasably receiving the at least one non-threaded shoulder standoff and a latch receptacle releasably engaging the latch to prevent withdrawal of the at least one non-threaded shoulder standoff from the opening; and a second slide member slidingly engaged lengthwise with the first slide member and having a plurality of shoulder standoff openings and a chassis latch receptacle coupled to the chassis.

13. The device of claim 12, wherein the latch comprises a spring plate.

14. The device of claim 12, wherein the opening adapted to receive the at least one non-threaded shoulder standoff comprises a key-hole shaped opening.

15. A device mountable in a rack, comprising:

a chassis;

a rail adapted to mount to opposing members of the rack, wherein the rail comprises a latch and a plurality of non-threaded standoffs;

a first slide having a latch receptacle adapted to engage the latch and a plurality of openings, each of the plurality of openings adapted to receive one of the plurality of non-threaded standoffs interlockingly therein without a threaded fastener; and a second slide sliding coupled to the first slide, the second slide having a plurality of shoulder standoff openings and a chassis latch receptacle coupled to the chassis.

16. The device of claim 15, wherein each of the plurality of non-threaded standoffs comprises a shaft and a head and each of the plurality of openings comprises a keyhole-shaped opening.

17. A system, comprising:

a rack;

a chassis; and a rail and slide assembly that slidingly supports the chassis in the rack, comprising:

a slide mechanism, comprising:

a first slide member having an opening and a latch receptacle; and a second slide member sliding coupled to the first slide member, the second slide member having a plurality of shoulder standoff openings and a chassis latch receptacle coupled to the chassis; and a rail coupled to the rack, wherein the rail includes at least one non-threaded shoulder standoff disposed in the opening and a latch engaged with the latch receptacle to secure the at least one non-threaded shoulder standoff removably within the opening.

18. The system of claim 17, wherein the latch comprises a spring-loaded structure.

19. The system of claim 17, wherein the opening comprises a key-hole shaped opening.

20. A rack system, comprising:

a rack structure;

a chassis;

a rail coupled to opposing members of the rack structure, wherein the rail comprises a latch and a plurality of non-threaded standoffs;

a first slide having a latch receptacle engaged with the latch and a plurality of openings, each of the plurality of openings interlockingly engaged with one of the plurality of non-threaded standoffs without a threaded fastener; and a second slide sliding coupled to the first slide, the second slide having a plurality of shoulder standoff openings and a chassis latch receptacle coupled to the chassis.

21. The rack system of claim 20, wherein each of the plurality of non-threaded standoffs comprises a shaft and a head and each of the plurality of openings comprises a keyhole-shaped opening.

* * * * *